United States Patent [19]

Webster

[11] 4,145,020

[45] Mar. 20, 1979

[54] RETRACTABLE APPARATUS FOR SUPPORTING AN ELEMENT

[75] Inventor: David L. Webster, Orange, Calif.

[73] Assignee: Kustom Fit Manufacturing Company, South Gate, Calif.

[21] Appl. No.: 870,759

[22] Filed: Jan. 19, 1978

[51] Int. Cl.[2] ..... F16M 11/00; A47C 7/54

[52] U.S. Cl. ..... 248/161; 297/417; 403/104; 403/109

[58] Field of Search ..... 248/161, 467, 408; 297/112–117, 162, 410, 416, 417; 403/104, 109

[56] References Cited

U.S. PATENT DOCUMENTS

| | | | |
|---|---|---|---|
| 2,215,758 | 9/1940 | Knight et al. | 297/115 |
| 2,858,876 | 11/1958 | Woodson | 297/417 X |
| 3,265,346 | 8/1966 | Petrick | 403/104 X |
| 3,697,103 | 10/1972 | Mostyn | 248/407 X |

*Primary Examiner*—James C. Mitchell

*Attorney, Agent, or Firm*—Fulwider, Patton, Rieber, Lee & Utecht

[57] ABSTRACT

Retractable apparatus for supporting an element such as the arm rest of a seat. The arm rest is movable from a retracted position adjacent the seat to an extended position above the seat by pulling it upwardly, slightly inclining it to one side, and then pushing it downwardly to lock it in the extended position. The apparatus comprises a pair of elongated members adapted for attachment to the seat and to the seat arm, respectively. One member is telescopable within the other and each includes complemental engagement portions freely movable relative to one another during movement of the arm rest to its extended position. The engagement portions are engageable when the arm rest is tipped to one side, thereby misaligning the longitudinal axes of the elongated members and locking the arm rest in the extended position. Various forms of engagement portions are disclosed.

19 Claims, 14 Drawing Figures

FIG. 1
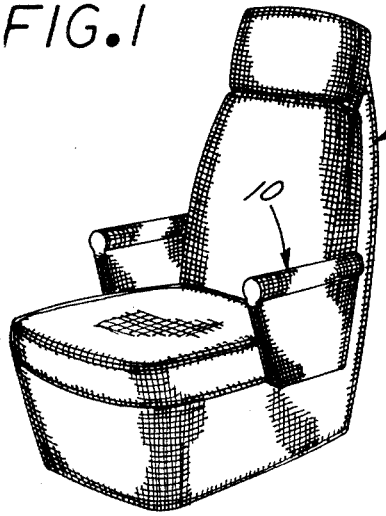
FIG. 2
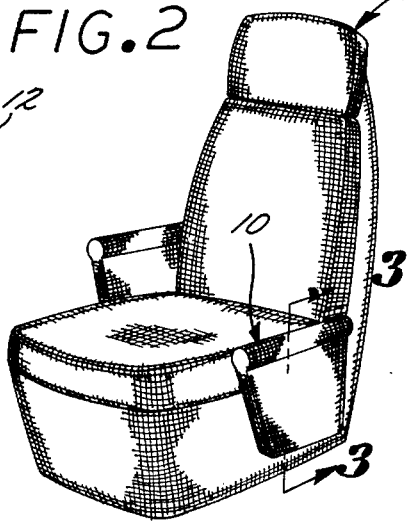
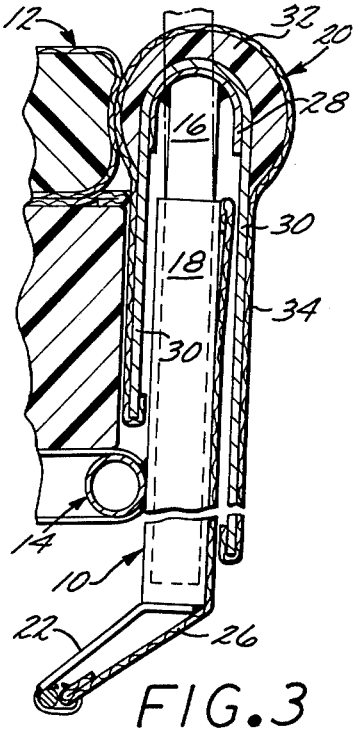
FIG. 3
FIG. 4
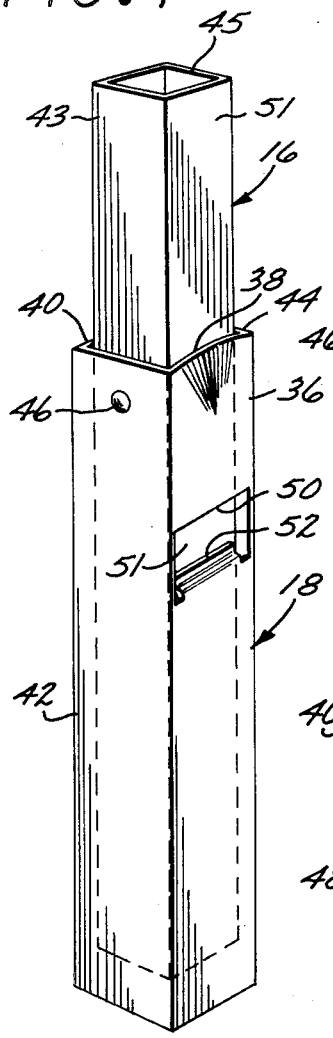
FIG. 5
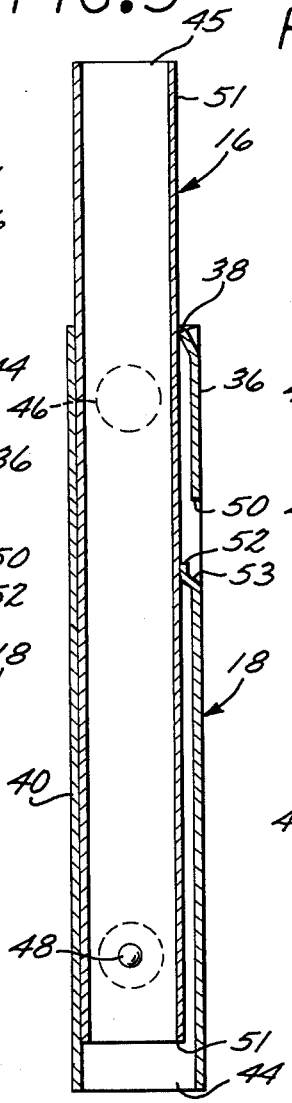
FIG. 6
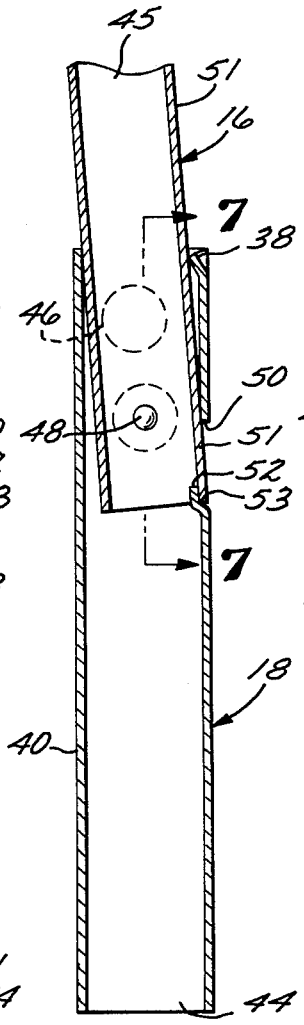
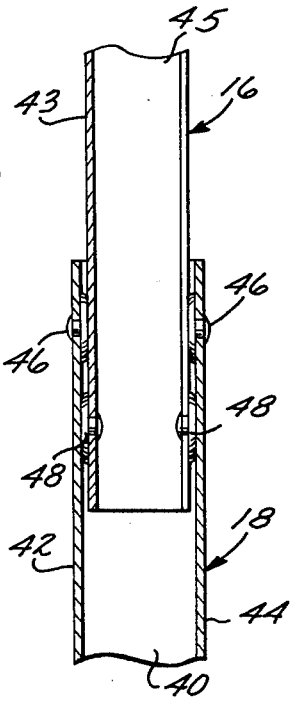
FIG. 7

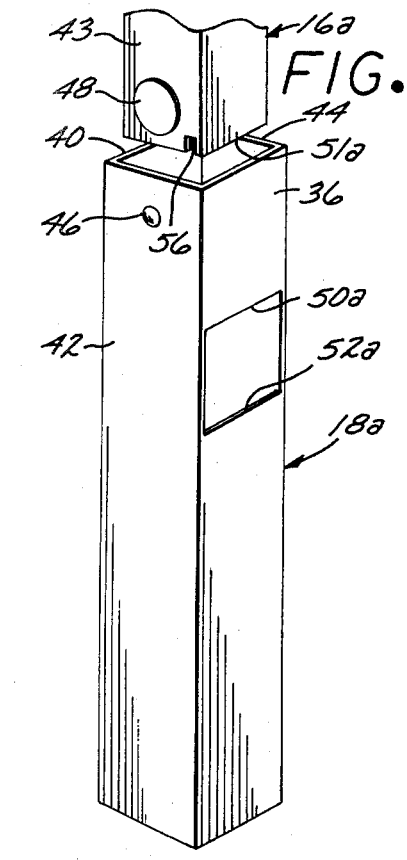
FIG. 8
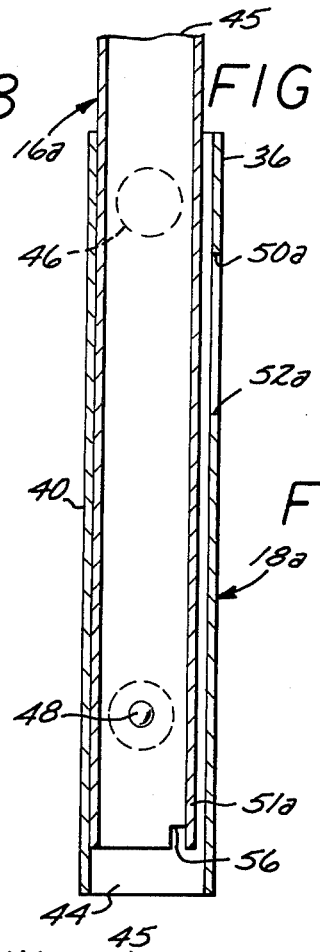
FIG. 9
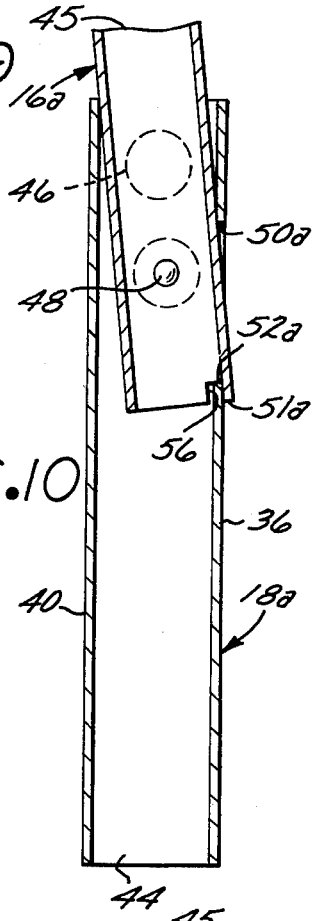
FIG. 10
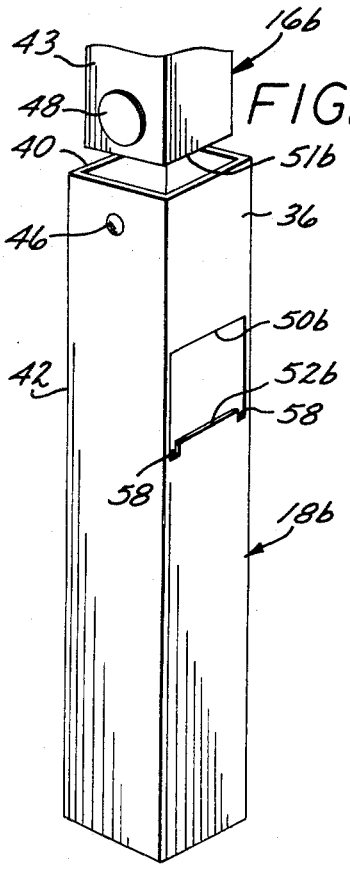
FIG. 11
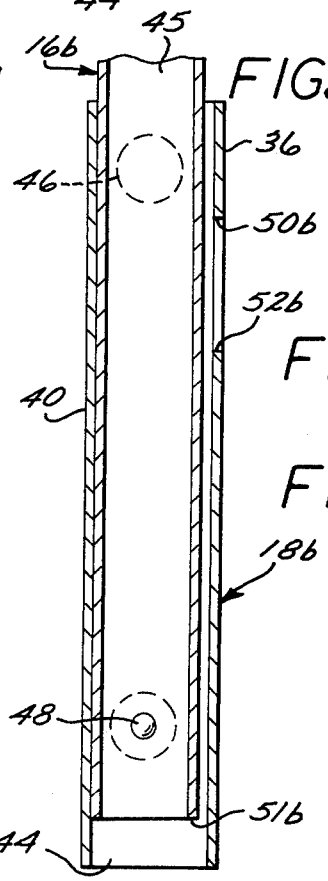
FIG. 12
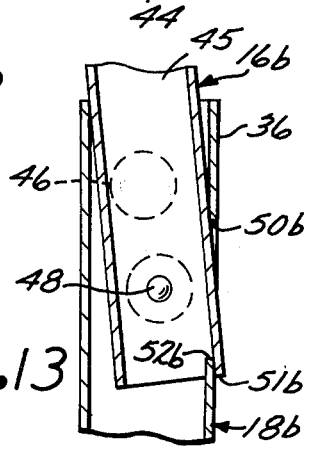
FIG. 13
FIG. 14
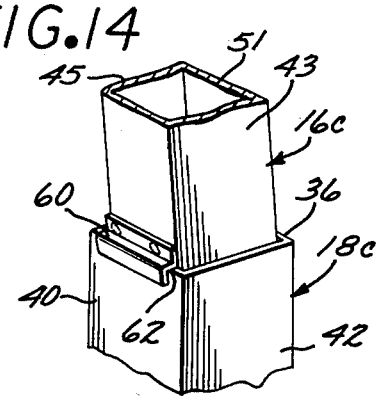

RETRACTABLE APPARATUS FOR SUPPORTING AN ELEMENT

BACKGROUND OF THE INVENTION

1. Field of the Invention

The present invention relates to a retractable apparatus for supporting an element such as an arm rest, and more particularly to a retractable apparatus comprising elongated members which are axially retractable rather than pivotally retractable relative to each other.

2. Description of the Prior Art

Retractable apparatus for supporting an element such as an arm rest, side table or tray for a seat or couch is often desirable to enable the element to be moved out of the way when it is not in use. Retractable apparatus is also useful in furniture applications where bed extensions, for example, must be retracted when not in use.

In the case of an arm rest for a vehicle seat, the arm rest is an impediment which prevents a person from easily sliding across the seat, and temporary retraction of the arm rest is desirable. Various arm rests have been proposed in the prior art which are pivotable from a retracted position in the seat back to an extended position for use. Other prior art arm rests are carried by supports adapted to extend into sockets in the seat frame. The arm rest in such a case is not retractable but is completely removed when passengers are to be seated. These and other prior art designs are either insecure, unsightly, comparatively expensive to manufacture, relatively complex to manufacture, or present upholstering problems which unduly increase the cost of fabricating the seat.

SUMMARY OF THE INVENTION

According to the present invention, a retractable apparatus is provided for supporting an element for easy extension for use. The apparatus is adapted to be locked in its extended position by slight lateral and subsequent downward movement of the supported element.

The retractable apparatus comprises elongated first and second members adapted for attachment to a supporting frame and to the supported element, respectively. The elongated members are movable relative to one another along coaxial longitudinal paths. However, one of the members is movable out of such longitudinal alignment in the extended position of the apparatus in order to lock the supported element in position. Both elongated members are provided with engagement portions freely movable past one another during normal extensible movement of the supported element, but interengageable upon lateral and subsequent downward movement of the supported element. In one embodiment one engagement portion takes the form of an edge defined by an opening provided in one elongated member, the other engagement portion comprising an extremity of the other elongated member.

Other objects and features of the invention will become apparent from consideration of the following description taken in connection with the accompanying drawings.

BRIEF DESCRIPTION OF THE DRAWINGS

FIG. 1 is a perspective view of a typical vehicle seat illustrating the supported element of the present retractable apparatus as an arm rest, the arm rest being shown in its extended position;

FIG. 2 is a view similar to FIG. 1, but illustrating the arm rest in its retracted position;

FIG. 3 is an enlarged view taken along the line 3—3 of FIG. 2;

FIG. 4 is an enlarged perspective view of a pair of lengths of square tubing comprising the elongated members adapted for attachment to the seat and the seat arm;

FIG. 5 is a longitudinal cross-sectional view of the structure illustrated in FIG. 4;

FIG. 6 is a view similar to FIG. 5, but illustrating the upper length of tubing located in an extended position;

FIG. 7 is a view taken along the line 7—7 of FIG. 6;

FIG. 8 is a perspective view of a second embodiment, illustrating a pair of lengths of square tubing adapted for attachment to a seat and a seat arm, the upper length of square tubing being illustrated separated from the lower length of square tubing to show the construction of its lower extremities;

FIG. 9 is a longitudinal cross-sectional view of the structure illustrated in FIG. 8, and showing the upper length of square tubing in its retracted position;

FIG. 10 is a view similar to FIG. 9, but illustrating the upper length of square tubing in its extended and locked position;

FIG. 11 is a perspective view of yet another embodiment, a pair of lengths of square tubing being illustrated which are similar to those illustrated in FIG. 8;

FIG. 12 is a longitudinal cross-sectional view of the structure of FIG. 11, but illustrating the upper length of tubing in its retracted position;

FIG. 13 is a view similar to FIG. 12, but illustrating the upper length of tubing in its extended and locked position; and FIG. 14 is a partial perspective view of a fourth embodiment of the present invention.

DESCRIPTION OF THE PREFERRED EMBODIMENTS

Referring now to the drawings, and particularly to FIGS. 1 through 7, there is illustrated apparatus for supporting an element which takes the form of an arm rest 10 for a seat 12. The particular seat 12 illustrated is merely exemplary. It is a seat particularly adapted for mounting to the floor of a recreational vehicle, and the arm rest 10 is retractable to simplify passenger ingress and egress.

Although not illustrated, if the seat 12 were made wider to seat two or more persons, an arm rest 10 could also be located in the middle of the seat. This would be particularly suitable for seats in aircraft.

Although the present retractable apparatus will be described hereinafter in connection with the support of the retractable arm rest 10, it will be apparent that the apparatus can also be used to support other elements in seating and furniture applications, such as retractable side tables, trays, foot rests, bed extensions or the like, and such other applications are contemplated as within the scope of the present invention.

The particular seat 12 illustrated is characterized by a seat frame 14, as seen in FIG. 3, covered by suitable upholstery or the like. The operating portions of the arm rest 12 are also upholstered, with the location and arrangement of the arm rest components being such that the arm rest is relatively unobtrusive in its retracted position, aesthetically blending with the seat proper.

The retractable apparatus for the arm rest 10 comprises a pair of elongated members in the form of square tubing lengths 16 and 18 adapted to be secured to the seat frame 14 and to a seat arm 20, respectively.

The tubing lengths 16 and 18 are each characterized by a rectangular cross-section, the lower tubing length 18 being welded adjacent its lower extremity to the seat frame 14. In addition, an elongated strap 22 is welded at one end to the lower end of the tubing length 18 and at the other end to a peripheral element of the seat frame 14. The strap 22 serves as an anchorage for upholstery 26 extending from the strap 22 and upwardly over the outside of the tubing length 18. The upholstery 26 is attached by any suitable means to the upper extremity of the tubing length 18, as best seen in FIG. 3.

An arcuate element 28 is welded to the upper end of the tubing length 16 to support an arm frame 30. The frame 30 mounts a suitable thickness of upholstery foam material 32, over which is arranged and attached suitable upholstery material 34. The material 34 is generally coextensive with the seat arm frame 30 to conceal the frame 30 in both its extended and retracted positions. As will be apparent to those skilled in the art, various other arrangements of arm frame and upholstery can be utilized, as desired, and the particular orientation and upholstery materials illustrated are merely exemplary.

The tubing lengths 16 and 18 are characterized by longitudinal axes which are coaxial during normal relative extension and retraction of the arm rest 10. The upper tubing length 16 is movable in a longitudinal path parallel to the lower tubing length 18.

The cross sectional area of the tubing length 18 is greater than that of the tubing length 16, and the spaces or clearances betwe n the exterior surfaces of the tubing length 16 and the complemental interior surfaces of the tubing length 18 thereby permit limited lateral movement of the tubing length 16 relative to the tubing length 18. In a typical embodiment the exterior dimensions of the tubing length 16 are 1" by 1", and that of the tubing length 18 are $1\frac{1}{4}$" by $1\frac{1}{4}$".

The tubing length 18 includes walls 36, 40, 42, and 44. The upper end of the wall 36 is inwardly dished or deformed to provide an arcuate section 38 which takes up most of the clearance between the tubing lengths 16 and 18 and thereby prevents vibration or rattling of the tubing 16 between the walls 36 and 40 of the tubing length 18.

The walls 42 and 44 are not inwardly deformed. However, the clearance between these walls and the complemental walls 43 and 45 of the tubing length 16 are taken up by a pair of buttons or friction elements 46 made of nylon or the like and mounted to the upper extremities of the walls 42 and 44 and arranged to frictionally bear against the complemental walls 43 and 45 of the tubing length 16. The friction elements 46 also promote smooth longitudinal sliding of the tubing length 16 relative to the tubing length 18 and tend to lightly constrain the seat arm 20 against dropping to its retracted position under the influence of gravity.

As best seen in FIG. 7, a similar pair of buttons or friction elements 48 are mounted to the lower extremities of the walls 43 and 45 of the tubing length 16, extending outwardly of the tubing length 16 and frictionally engaging the adjacent inner surfaces of the walls 42 and 44 of the tubing length 18. The elements 48 also serve as limits or stops, engaging the elements 46 close to the extended position of the tubing length 16 to prevent the user from inadvertently separating the tubing length 16 from the tubing length 18 and also serving to locate the tubing length 16 in optimum position for tipping in its extended position, as will be seen.

The wall 36 of the tubing length 18 includes a generally rectangular opening 50 adjacent its upper extremity, the lower edge 52 of the opening 50 being inwardly deformed a distance approximating the distance the upper end of the wall 36 is inwardly deformed to define the arcuate section 38. In the typical embodiment previously mentioned, this would be approximately 0.11 inches. In addition, the side portions of the edge 52 are cut away so that the reduced width of the edge 52 is such that it just fits between the inner surfaces of the walls 43 and 45 of the tubing length 16.

The width of the opening 50 is preferably the same as the distance between the outside surfaces of the walls 42 and 44, and the height of the opening 50, measured between the edge 52 and the upper edge of the opening, is approximately $\frac{1}{2}$ inch.

With this arrangement, the lower edge of the wall 51 of tubing length 16 constitutes an engagement portion adapted to overlap or fit over the engagement portion or edge 52 of the tubing length 18 in a canted position of the tubing length 16, as seen in FIG. 6.

The canted position of the tubing length 16, in which the longitudinal axes of the tubing lengths 16 and 18 are misaligned, is achieved by pulling upwardly upon the arm rest 10 until the elements 46 and 48 engage. At this point the lower end of the wall 51 of the tubing length 16 is located approximately $\frac{1}{8}$ inch above the edge 52 of the tubing length 18. A slight movement of the seat arm 20 inwardly toward the user then shifts the lower edge of the wall 51 from a position in which it is out of longitudinal alignment with the edge 52, and into a position in which it is longitudinally aligned with the edge 52. Thereafter, a short downward movement of the arm rest 10 interengages and overlaps the lower edge of the wall 51 and the edge 52 and prevents the tubing length 16 from moving downwardly or laterally.

Although the degree of downward movement of the seat arm 20 is slight, interengagement of the lower edge of the wall 51 and the edge 52 is positive and secure. In this regard, the particular shape of the edge 52 tends to prevent wedging or binding between the lower edge of the wall 51 and the edge 52. Thus, the edge 52 extends inwardly to define a platform or shelf 53, and thereafter extends upwardly so that it will be generally parallel to the adjacent wall 51 when the wall lower edge is resting upon the shelf 53. The shelf 53 eliminates any wedging action of the lower edge of the wall 51 on the edge 52, and disengagement is easily effected by simply pulling upwardly upon the arm rest 10 and moving it laterally, away from the user in the illustrated embodiment. This locates the lower edge of the wall 51 out of longitudinal alignment with the edge 52, permitting the seat arm 20 to be moved downwardly into the retracted position illustrated in FIG. 2.

Referring now to FIGS. 8 through 10, there is illustrated another embodiment of the present apparatus, the embodiment of FIGS. 8 through 10 being substantially similar to the embodiment of FIGS. 1 through 7. Accordingly, parts which are identical are assigned like numerals. Parts which are not identical but which have a related function are assigned like numerals with letter subscripts.

The inward deformation of the upper edge of the wall 36 to provide the section 38 is omitted for economy of manufacture, as is the inner deformation of the lower edge of the opening. Instead, an edge 52*a* is provided which is simply the lower edge of a punched out opening 50*a* approximately 1⅛ inches high, the edge 52 being adapted to cooperate with the lower edge of the wall 51*a* of the tubing length 16*a*.

A pair of notches 56 are provided on opposite sides of the lower edge of the wall 51*a* to fit over the edge 52*a* in the extended position of the arm rest, as illustrated in FIG. 10. Each slot 56 is preferably twice the wall thickness of the wall 36 to permit locking interengagement without undesirable wedging.

Yet another embodiment of the present apparatus is illustrated in FIGS. 11 through 13. This embodiment is substantially identical to the embodiment of FIGS. 8 through 10, except that the notches 56 of the embodiment of FIGS. 8 through 10 are omitted. Instead, the edge 52*b* of the opening 50*b* in the tubing length 18*b* is bounded at its opposite sides by a pair of notches 58. As best seen in FIG. 13, the notches 58 receive the outer portions of the walls 43 and 45 of the tubing length 16*b*, and the lower edge of the wall 51 overlies the edge 52*b* in the locked position of the arm rest.

If desired, greater adjustability of height of the arm rest 10 can be achieved by employing a plurality of vertically spaced openings 50 (not shown), as will be apparent.

In each of the described embodiments the arm rest 10 is normally located in the position illustrated in FIG. 2. This permits a passenger to slide across the seat 12. Thereafter the arm rest 10 can be pulled upwardly until it is in the extended position illustrated in FIG. 1. This movement raises the upper tubing length 16 from its lowermost position to an uppermost position in which the elements 46 and 48 are engaged. The user then inwardly pivots or laterally cants the arm rest 10 toward the seat 12, and next downwardly presses the arm rest 10 until the lower end of the upper tubing length is engaged upon the lower edge of the opening in the lower tube length. In this location the arm rest 10 is locked in its extended position and is highly resistant to downwardly or laterally directed loads. Return of the arm rest to its retracted position is easily accomplished by a slight upward pull upon the seat arm 20, followed by an outward lateral tipping to locate the lower end of the upper tubing length out of longitudinal alignment with the lower edge of the opening in the lower tubing length. The arm rest is then freely movable to its retracted position by exerting a steady downward pressure upon it.

The various embodiments illustrate different forms of engagement portions to effect the desired locking interengagement of the tubing lengths 16 and 18 in the extended position of the arm rest 10. Other configurations and locations of such engagement portions will suggest themselves to those skilled in the art and are a part of the present invention. For example, instead of employing the lower end of the tubing length 16 as an engagement portion, a projection can be attached to the tubing length 16 for engagement with an edge of the opening in the tubing length 18. For that matter a projection such as a clip 60 may constitute an engagement portion for engaging upon the upper end of the tubing length 18, as illustrated in FIG. 14. The clip 60 is formed to define a recess 62 which receives the upper edge of the wall 40 of the tubing length 18 in the locked relation of the tubing lengths 16 and 18.

In the various embodiments illustrated the upper tubing length is shown as telescopable within a lower tubing length of greater transverse cross-section. However, it will be apparent that this arrangement can be reversed. Thus, in the embodiment of FIGS. 1 through 7, for example, the smaller tubing length 16 could be attached to the seat frame 14, and the larger tubing length 18 attached to the seat arm 20. In addition, the elongated members need not be square tubing lengths 16 and 18, but could be made of circular, channel or other cross section.

In each of the embodiments the extension and retraction of the supported element is easily accomplished with one hand, and the retractable apparatus is firm and rigid in its extended position so that a feeling of solidity is given to the user.

Various modifications and changes may be made with regard to the foregoing detailed description without departing from the spirit of the invention.

I claim:

1. Retractable apparatus for supporting an element, said apparatus comprising:

elongated first support means for attachment to a supporting frame and having a first engagement portion; and elongated second support means adapted to mount an element to be supported and having a second engagement portion, said second support means being movable in a longitudinal path generally parallel to said first support means and between a retracted position and an extended position relative to said first support means, said second engagement portion being out of longitudinal alignment and freely movable relative to said first engagement portion during movement of said second support means along said longitudinal path, said first and second engagement portions being adjacent in said extended position, said second support means in said extended position being laterally movable relative to said first support means to locate said first and second engagement portions in general longitudinal alignment whereby longitudinal movement of said second support means toward said retracted position engages said first and second engagement portions in overlapping, locked relation and thereby prevents lateral movement of said second support means and also prevents further longitudinal movement of said second support means toward said retracted position.

2. Retractable apparatus according to claim 1 wherein said first support means is tubular and said second support means is slidably movable within said first support means during movement of said second support means along said longitudinal path.

3. Retractable apparatus according to claim 1 wherein said first support means includes a first elongated member having an opening adjacent one extremity, and said second support means includes a second elongated member telescopably movable along said longitudinal path within said first member, an edge of said opening constituting said first engagement portion, and said second engagement portion constituting a portion of an end of said second member.

4. Retractable apparatus according to claim 1 wherein said first support means includes a flat wall, and said second support means includes a length of tubing telescopably movable along said longitudinal path adjacent said flat wall, said flat wall including an opening adjacent one extremity, the lower edge defining said opening constituting said first engagement portion, and the lower edge of the lower end of said length of tubing constituting said second engagement portion, said lower edge of said length of tubing being adapted to fit over said lower edge of said opening in said locked relation.

5. Retractable apparatus according to claim 4 wherein said lower edge of said opening is inwardly deformed for slidable engagement with the adjacent wall of said length of tubing.

6. Retractable apparatus according to claim 4 wherein the upper portion of said flat wall in inwardly deformed for slidable engagement with the adjacent wall of said length of tubing.

7. Retractable apparatus according to claim 4 wherein said first support means includes a pair of walls adjacent said flat wall, and including a pair of opposed friction elements mounted to the interior surfaces of said pair of walls for slidable engagement with the adjacent walls of said length of tubing.

8. Retractable apparatus according to claim 7 wherein said length of tubing is rectangular in cross section, and including a pair of stop elements mounted to the exterior surfaces of a pair of opposite side walls of said length of tubing for engagement with said pair of friction elements, respectively, in said extended position.

9. Retractable apparatus for supporting an element, said apparatus comprising:

a first length of tubing having adjacent one extremity a first engagement portion; and a second length of tubing having adjacent one extremity a second engagement portion, said second length being telescopably slidable within said first length in a longitudinal path generally parallel to the longitudinal axis of said first length, and between a retracted position and an extended position relative to said first length, said second engagement portion being out of longitudinal alignment and freely movable relative to said first engagement portion during movement of said second length along said longitudinal path, said first and second engagement portions being adjacent in said extended position, said second length in said extended position, being laterally movable relative to said first length to locate said first and second engagement portions in general longitudinal alignment whereby longitudinal movement of said second length toward said retracted position engages said first and second engagement portions in overlapping, locked relation and thereby prevents lateral movement of said second length and also prevents further longitudinal movement of said second length toward said retracted position, one of said first and second lengths being adapted for connection to a supporting frame and the other of said lengths being adapted to mount an element to be supported.

10. Retractable apparatus according to claim 9 wherein said first and second lengths are each made of square tubing.

11. Retractable apparatus according to claim 10 wherein said first engagement portion comprises an edge of an opening formed in a first wall of the four walls of said first length, said second engagement portion comprises the end edge of a first wall of the four walls of said second length, said edge of said second length being adapted to fit over said edge of said first length in said locked position.

12. Retractable apparatus according to claim 11 wherein said edge of said opening is less wide than said edge of said first wall whereby said edge of said opening fits within the lower end of said second length in said locked relation.

13. Retractable apparatus according to claim 10 wherein said first length includes an opening in a first wall of its four walls, an edge of said opening constituting said first engagement portion, the lower edge of an end of said second length constituting said second engagement portion, said edges being adapted to interengage in said locked relation.

14. Retractable apparatus according to claim 13 wherein said first wall of said first length is inwardly deformed in an area spaced from said opening for slidable engagement with the adjacent wall of said second length.

15. Retractable apparatus according to claim 13 wherein said edge of said opening of said first length is inwardly deformed to define a shelf generally normal to the plane of said first wall for support of a wall of the lower end of said second length in said locked relation.

16. Retractable apparatus according to claim 11 and including a pair of opposed friction elements mounted to the interior surfaces of the pair of confronting side walls adjacent said first side wall of said first length for slidable engagement with the adjacent walls of said second length.

17. Retractable apparatus according to claim 15 and including a pair of stop elements mounted to the exterior surfaces of a pair of opposite side walls of said second length for engagement with said pair of friction elements, respectively, and establishing said extended position.

18. Retractable apparatus according to claim 13 wherein portions of the pair of walls adjacent said lower edge of said end of said second length are cut away to define recesses for reclining said edge of said opening of said first length in said locked relation.

19. Retractable apparatus according to claim 9 wherein said second engagement portion comprises a projection on the outer surface of said second length, and said first engagement portion comprises an end edge of said first length, said projection being adapted to fit over said end edge in said locked relation.

* * * * *